US005318379A

United States Patent [19]

Ezell et al.

[11] Patent Number: 5,318,379

[45] Date of Patent: Jun. 7, 1994

[54] PREFORMED ELASTOMERIC JOINT SEALANT INSTALLER

[76] Inventors: George C. Ezell, 20 Poplar, La Luz, N. Mex. 88337; David L. Bailey, 2503 Hawaii, Alamogordo, N. Mex. 88310

[21] Appl. No.: 996,965

[22] Filed: Dec. 23, 1992

[51] Int. Cl.[5] ..... E01C 23/02

[52] U.S. Cl. ..... 404/87; 404/49

[58] Field of Search ..... 404/87, 47–49, 404/68; 52/743

[56] References Cited

U.S. PATENT DOCUMENTS

| | | | |
|---|---|---|---|
| 2,354,586 | 7/1944 | Fischer . | |
| 3,038,397 | 6/1962 | Middlestadt | 404/87 |
| 3,200,482 | 8/1965 | Brown . | |
| 3,422,734 | 1/1969 | Tonjes et al. . | |
| 3,466,988 | 9/1969 | Sharpe . | |
| 3,473,450 | 10/1969 | Koch | 404/87 |
| 3,570,379 | 3/1971 | Johnson | 404/87 |
| 3,608,445 | 9/1971 | Sharpe . | |
| 3,718,403 | 2/1973 | Kerschner | 404/49 |
| 4,765,771 | 8/1988 | Howsley | 404/87 X |
| 5,141,358 | 8/1992 | Burke et al. | 404/49 |

*Primary Examiner*—Kenneth J. Dorner
*Assistant Examiner*—Nancy Mulcare
*Attorney, Agent, or Firm*—Zarley, McKee, Thomte, Voorhees & Sease

[57] ABSTRACT

The sealant installer is pulled along the roadbed over the joint to be sealed and the installer wheel engaging the road surface on opposite sides of the joint slot pulls sealant by operation of teeth engaging the sealant through a lubricated feed chute which reduces the cross sectional width of the sealant to a size smaller than the width of the slot in the joint. Timing is assured without bunching or stretching of the sealant.

22 Claims, 3 Drawing Sheets

PREFORMED ELASTOMERIC JOINT SEALANT INSTALLER

BACKGROUND OF THE INVENTION

This invention relates to a machine for inserting a cord of elastomeric joint sealant in the expansion and contraction slot in concrete surfaces such as highways and airport runways.

Machines previously used to install the continuous cord of preformed elastomeric joint sealant are slow, expensive and experience timing problems. The device that places the sealant in the slot must be timed as it moves along the road surface with the feeding of the sealant cord to the slot. If the timing is not precise, too much sealant material will be provided and it will bunch up or if too little sealant material is supplied, then it will be stretched rendering it ineffective for sealing the joint.

Thus what is needed is a machine that is simple in construction and operation and is automatic in its timing of travel relative to feeding of the sealant to the joint.

SUMMARY OF THE INVENTION

The joint sealant installer of this invention is quite simple in construction and operation and provides self timing of the cord sealant to the joint slot as the machine moves along the road surface.

The critical feature for accomplishing self timing is in the fact that the installer wheel engaging the cord sealant for inserting it into the slot also engages the road surface to cause its rotation as the machine is moved along the road surface upon being pulled by a prime mover such as a tractor or pickup truck. Specifically, the inserter wheel includes spaced apart teeth around its periphery with annular road engaging shoulders on either side thereof diametrically inwardly offset allowing the teeth to be positioned in the slot. Therefore, if the interior wheel does not turn, no sealant is fed to the slot and when the wheel does turn, the teeth on the periphery of the wheel provide a positive feed of the sealant to the slot. The teeth perform the multiple functions of pulling the sealant through a feed chute, maintaining the machine aligned with the slot and then inserting it into the slot. The annular shoulders of the wheel may be covered with rubber material to increase the friction with the road surface.

Friction in the feed chute is reduced by lubricant being supplied on both sides and the bottom. The lower end of the feed chute is reduced in cross section to compress the sealant to a width smaller than the slot for ease of insertion. The feed chute may be adjustably positioned relative to the inserter wheel such that insertion of the cord into the chute against the teeth on the wheel will cause feeding of the sealant into the slot immediately upon the wheel starting to rotate in response to movement along the road surface.

DESCRIPTION OF PREFERRED EMBODIMENT

Figure 1:
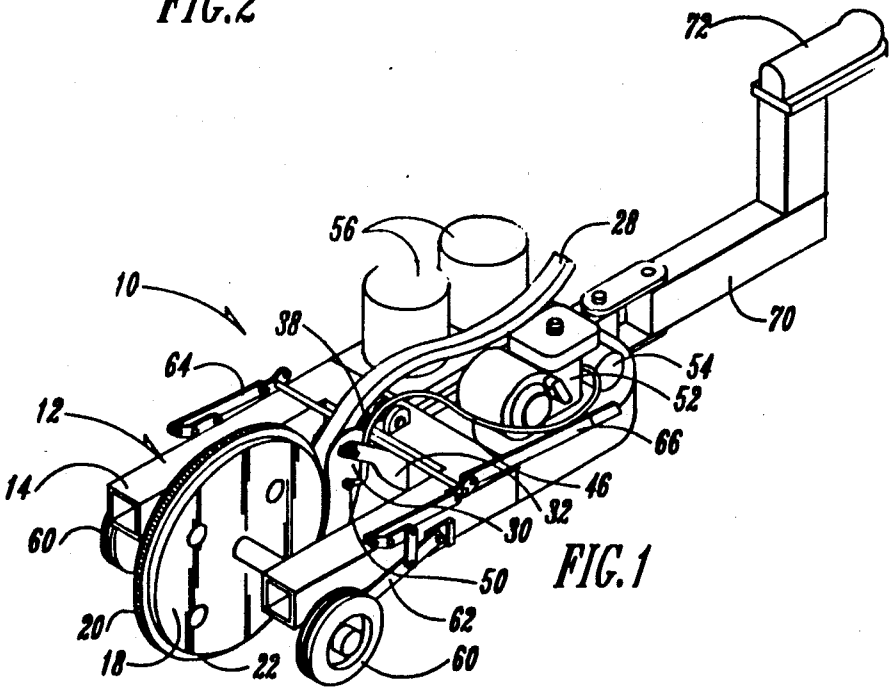
FIG. 1 is a perspective view of the joint sealant installer of this invention.
Figure 7:
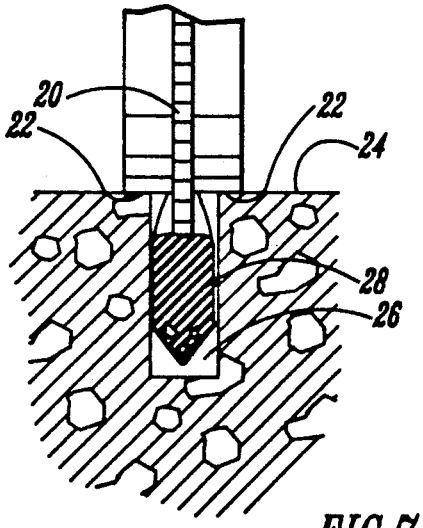
FIG. 7 is a cross sectional view taken along line 7—7 in FIG. 4 and similar to FIG. 6 but showing the inserter wheel.

The joint sealant installer of this invention is referred to in FIG. 1 generally by the reference numeral 10 and includes a frame 12. The frame 12 has a U-shaped rear portion including a pair of rearwardly extending arms 14 between which an axle 16 extend for rotatably supporting an inserter wheel 18. The inserter wheel 18 is approximately 18 inches in diameter and includes spaced apart teeth 20 around its periphery centrally disposed between diametrically inwardly offset annular shoulders 22 as seen in FIG. 7. The shoulders 22 are approximately one inch wide and are covered with rubber to increase the friction with the road surface 24 on opposite sides of a joint slot 26 into which the preformed elastomeric sealant 28 is inserted. The sealant 28 is available from D.S. Brown Company, North Baltimore, Ohio and is sold under the trademark DELASTIC®.

Figure 4:
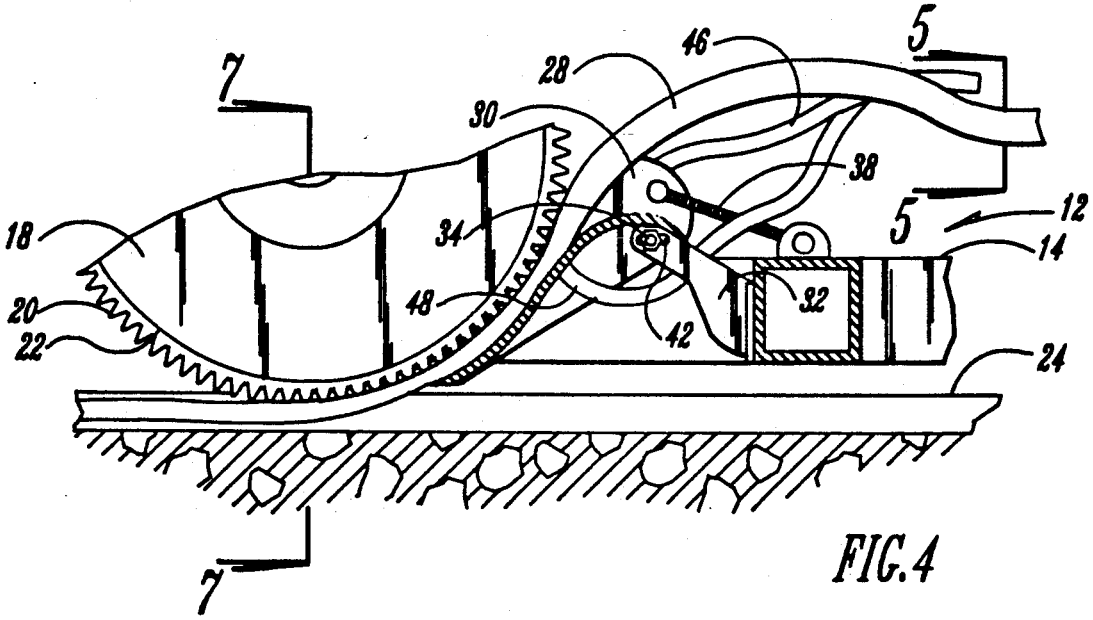
FIG. 4 is an enlarged cross sectional view taken along line 4—4 in FIG. 3.
Figure 5:
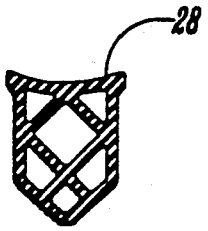
FIG. 5 is a cross sectional view taken along line 5-5 in FIG. 4.
Figure 6:
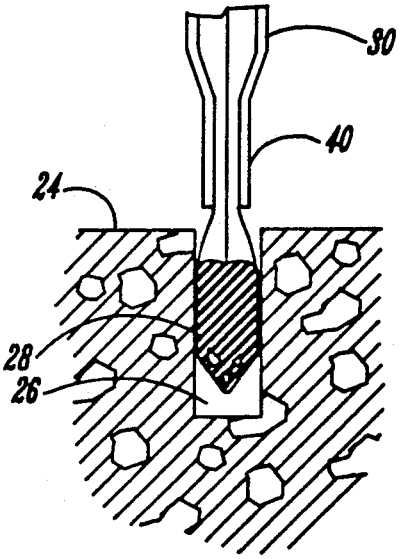
FIG. 6 is a cross sectional view of the feed chute delivering sealant into the joint slot.
Figure 8:
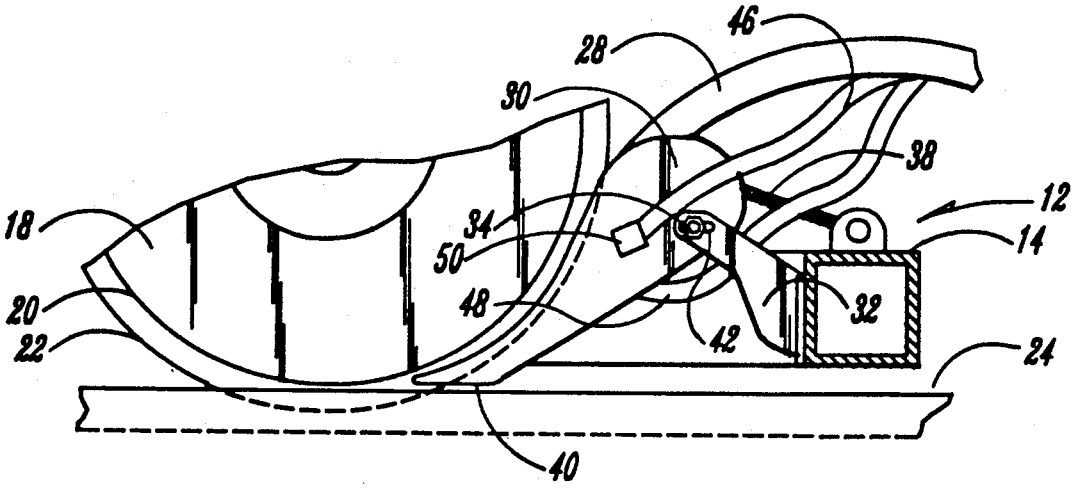
FIG. 8 is a fragmentary side elevational view of the feed chute and inserter wheel relative to the joint slot.
Figure 9:
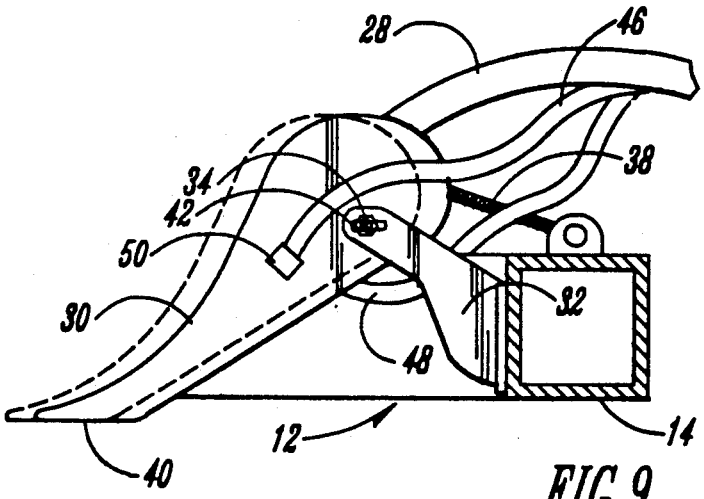
FIG. 9 is a side elevational view of the feed chute adjustably the frame.
Figure 10:
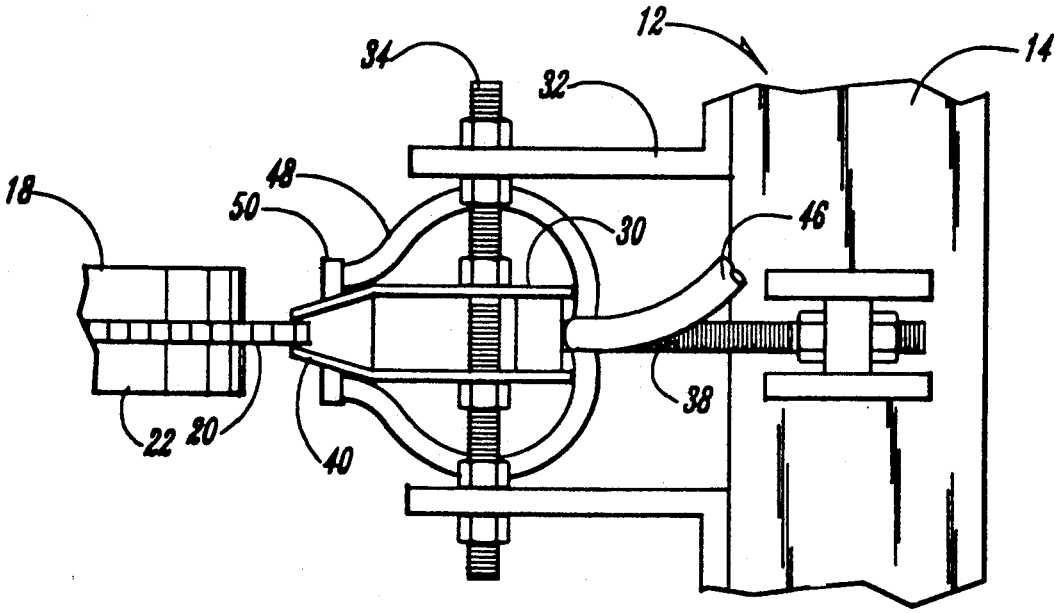
FIG. 10 is a fragmentary top plan view of the feed chute showing the adjustment means and the inserter wheel.

A feeder chute 30 is pivotally mounted on a pair of arms 32 through which an adjustment bolt 34 extends. The feed chute 30 is U-shaped and may be locked in a desired position relative to the inserter wheel 18 by an adjustment bolt 38 as seen in FIG. 9. The chute 30 includes a lower end 40 having a reduced in cross section passageway for compressing the sealant 28 as seen in FIGS. 6 and 10 to a size smaller than the width of the slot 26 in the road surface. It is seen that the lower end 40 of the chute is closely adjacent the road surface and the forward side of the inserter wheel as seen in FIGS. 4 and 8. Horizontally elongated slots 42 in the arms 32 allow horizontal positioning of the chute 30 relative to the inserter wheel 18 as seen in FIG. 9.

The elastomeric sealant 28 is approximately 13/16th inch wide and high and is received in a joint slot approximately ½ inch wide. The lower end 40 of the feed chute 30 compresses the sealant to approximately ⅜ inch width.

Friction in the feed chute 30 is reduced by lubricant being supplied through a hose 46 as seen in FIG. 10 which splits off into feeder tubes 48 on opposite sides of the lower end 40 wherein nozzles 50 allow injection of the lubricant into the chute around the sealant 28. A third lubricant tube 48 is provided on the bottom side of the chute 30 to assure total lubrication of the sealant 28 as it is pulled through the chute by the inserter wheel 18 and is placed in the joint slot 26.

Figure 2:
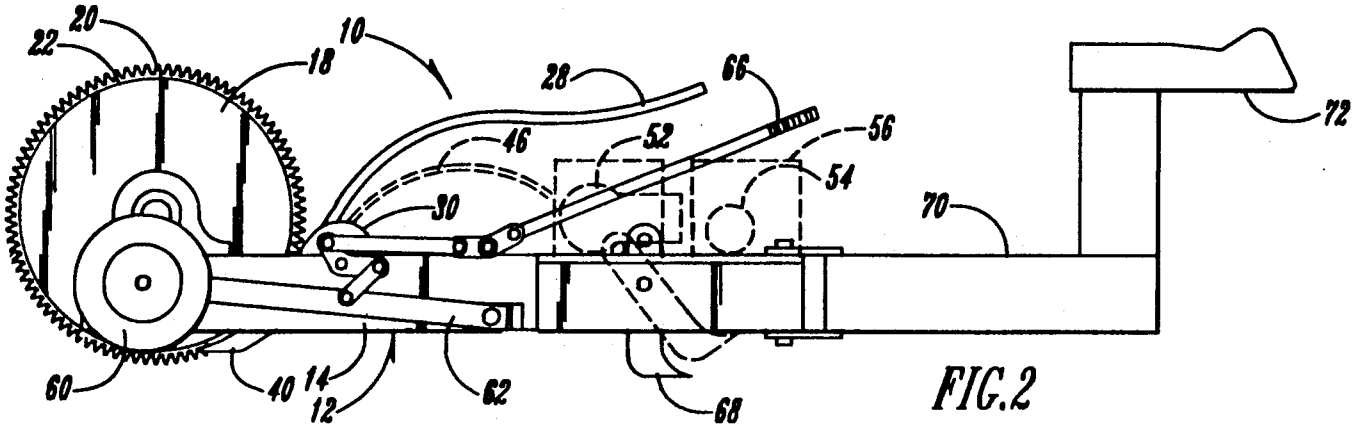
FIG. 2 is a side elevational view thereof.
Figure 3:
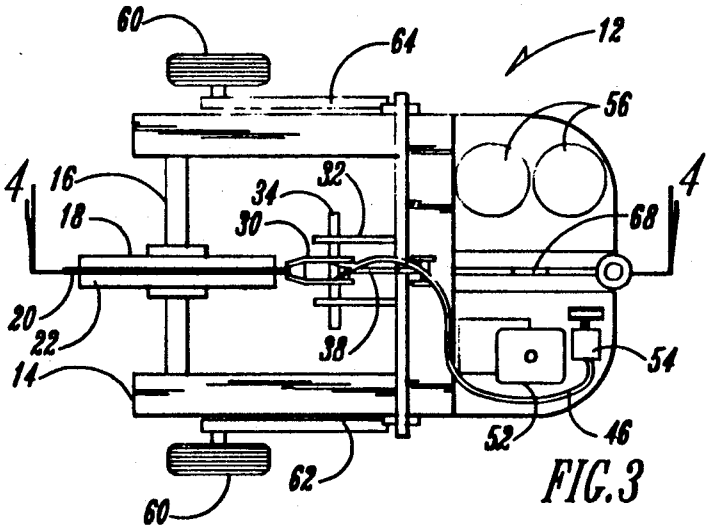
FIG. 3 is a top plan view thereof.

In FIGS. 1 and 2 it is seen that an engine 52 is provided for operating a lubricant pump 54 receiving adhesive-type lubricant from reservoirs 56. A supply of coiled sealant (not shown) may be mounted on the frame 12 or in a pickup truck (not shown) being used as a prime mover.

Stabilizer wheels 60 are mounted on arms 62 operated through a linkage 64 having a handle 66 as seen in FIGS. 1 and 2 to ensure vertical alignment of the inserter wheel.

A guide member 68 is pivotally mounted on the frame 12 as seen in FIG. 2 for placement in the joint slot 26 in alignment with the wheel 18 and the line of travel of the machine over the road surface. It is seen that the guide member 68 may be pivoted to its upward transport position as shown in dash lines in FIG. 2.

A tongue 70 is pivotally connected to the frame 12 at its forward end thereby allowing for alignment correction as the installer machine 10 is pulled along a road surface. A ball hitch 72 is provided on the forward end of the tongue for being connected to a ball on a pickup truck or tractor prime mover.

In operation it is seen that the installer 10 is moved around the job site on the stabilizer wheels 60 which are then retracted with the teeth 20 being positioned in the joint slot 26 along with the guide 68. The cord of sealant 28 is fed into the feeder chute 30 down against the teeth 20. The sealant installer is then pulled across the road surface with the installer wheel 18 being caused to rotate due to the frictional contact of the annular shoulders 22 engaging the road surface thereby causing the teeth 20 to pull the sealant 28 through the chute 30 which reduces it in size to fit into the slot 26 in the joint. Operation of the engine 66 feeds adhesive lubricant to the feed chute to minimize drag therethrough.

It is important to note that the sealant installer of this invention ensures self timing of the inserter wheel 18 to the feeding of the sealant 28 since there is a positive engagement between the teeth 20 and the sealant 28. It is only when the inserter wheel 18 is turned that sealant is fed to the slot 26 thereby avoiding any bunching of the sealant in the slot or stretching of the sealant as has been a problem with prior art machines. It has been found that over 100 feet per minute of sealant can be installed in the joint of a road surface. This is many times faster than the machines presently available.

What is claimed is:

1. A preformed elastomeric joint sealant installer comprising a frame, an installer wheel rotatably mounted on said frame for rotation about a horizontal axis said installer wheel having a periphery, a first friction means along the periphery of said installer wheel and rotating about the same horizontal axis as the installer wheel for engaging a road surface and rotating said installer wheel as said frame is moved horizontally over said road surface, and a second friction means along the periphery of said installer wheel for engaging an endless cord of sealant, said second friction means being closely adjacent said first friction means and extending outwardly from said installer wheel periphery further than said first friction means whereby said second friction means is received in the slot of a joint with said first friction means engaging the road surface for driving said installer wheel and feeding said sealant into said joint slot as said frame is moved over said road surface.

2. The structure of claim 1 wherein said first friction means is an annular shoulder adjacent said second friction means.

3. The structure of claim 2 wherein said second friction means includes teeth spaced around the periphery of said installer wheel.

4. The structure of claim 1 wherein said second friction means includes teeth spaced around the periphery of said installer wheel.

5. The structure of claim 1 wherein said first friction means includes closely adjacent annular shoulders on opposite sides of said second friction means which includes teeth spaced around said periphery.

6. The structure of claim 1 and a sealant feed chute for guiding said sealant into engagement with said second friction means.

7. The structure of claim 6 wherein said installer wheel has forward and rearward sides and said chute is positioned on said frame on the forward side of said wheel facing the direction of travel of said installer wheel.

8. The structure of claim 7 wherein said chute has upper and lower ends and the installer lower end is closely positioned adjacent to said wheel periphery at its lower forward side to be adjacent the upper end of said joint slot.

9. The structure of claim 8 wherein said lower end of said chute has a passageway which is reduced in cross section relative to said upper end to compress said sealant to a size smaller than the width of said joint slot.

10. The structure of claim 9 wherein said chute includes lubricant feed means for supplying said sealant with lubricant as it moves through said chute and into a joint slot.

11. The structure of claim 10 wherein the chute has a bottom and two sides and said lubricant feed means includes nozzles at both sides of said chute and in the bottom thereof.

12. The structure of claim 1 and a guide member is mounted on said frame and is longitudinally spaced from and is in alignment with said installer wheel and the line of intended travel, said guide member is received in a joint slot for keeping said installer wheel aligned with said joint slot.

13. The structure of claim 12 wherein said guide member is adjustable between raised and lowered positions and is received in said joint slot when in said lowered position.

14. The structure of claim 1 and retractable stabilizer wheels are provided on said frame.

15. The structure of claim 1 and said frame has forward and rearward ends and a tongue is pivotally connected at its rear end to said forward end of said frame, the forward end of said tongue being adapted to be connected to a prime mover.

16. The structure of claim 2 and rubber material is provided on said annular shoulder to increase friction between said shoulder and a road surface.

17. The structure of claim 5 and rubber material is provided on said annular shoulders to increase friction between said annular shoulders and a road surface.

18. The structure of claim 6 wherein said chute has a lower end and an upper end and wherein said lower end of said chute has a passageway which is reduced in cross section relative to said upper to compress said sealant to a size smaller than the width of said joint slot.

19. The structure of claim 18 and adjustment means is provided for selectively positioning said chute next to said installer wheel.

20. A preformed elastomeric joint sealant installer comprising, a frame, an installer wheel rotatably mounted on said frame for rotation about a horizontal axis, said installer wheel having a periphery, a first friction means along the periphery of said installer wheel for engaging a road surface and rotating said installer wheel as said frame is moved horizontally over said road surface, and a second friction means along the periphery of said installer wheel for engaging an endless cord of sealant, said second friction means extending outwardly from the installer wheel periphery further than said first friction means whereby said second friction means is adapted to be received in the slot of a joint with said first friction means engaging the road surface for driving said installer wheel and feeding said sealant into said joint slot as said frame is moved over said road surface, a sealant feed chute for guiding said sealant into engagement with said second friction means, said installer wheel having forward and rearward sides and said chute being positioned on said frame on the said forward side of installer wheel facing the direction of travel of said installer wheel, said chute having upper an lower ends and said lower end being closely positioned adjacent to the installer wheel periphery at its lower forward side to be adjacent the upper end of said joint slot, and said chute including lubricant feed means for supplying said sealant with the lubricant as it moves through said chute and into a joint slot.

21. A preformed elastomeric joint sealant installer comprising, a frame, an installer wheel rotatably mounted on said frame for rotation about a horizontal axis, said installer wheel having a periphery a first friction means along the periphery of said installer wheel for engaging a road surface and rotating said installer wheel as said frame is moved horizontally over said road surface, and a second friction means along the periphery of said installer wheel for engaging an endless cord of sealant, said second friction means extending outwardly from the installer wheel periphery further than said first friction means whereby said second friction means is adapted to be received in the slot of a joint with said first friction means engaging the road surface for driving said installer wheel and feeding said sealant into said joint slot as said frame is moved over said road surface, a sealant feed chute for guiding said sealant into engagement with said second friction means, said chute having an upper end and a lower end and a passageway at said lower end which is reduced in cross section relative to said upper end to compress said sealant to a size smaller than the width of said joint slot, and adjustment means being provided for relatively positioning said chute next to said installer wheel.

22. The structure of claim 21 wherein said chute has a bottom and a lubricant feed means and said lubricant feed means includes nozzles on both sides of said chute and in the bottom thereof.

* * * * *